US012478114B2

(12) United States Patent
McCurry et al.

(10) Patent No.: US 12,478,114 B2
(45) Date of Patent: Nov. 25, 2025

(54) BIB

(71) Applicants: Elena McCurry, Clearwater, FL (US); Keti Keti Splinter, St. Petersburg, FL (US)

(72) Inventors: Elena McCurry, Clearwater, FL (US); Keti Keti Splinter, St. Petersburg, FL (US)

( * ) Notice: Subject to any disclaimer, the term of this patent is extended or adjusted under 35 U.S.C. 154(b) by 0 days.

(21) Appl. No.: 18/641,580

(22) Filed: Apr. 22, 2024

(65) Prior Publication Data

US 2024/0358093 A1 Oct. 31, 2024

Related U.S. Application Data

(60) Provisional application No. 63/461,715, filed on Apr. 25, 2023.

(51) Int. Cl.
*A41B 13/10* (2006.01)

(52) U.S. Cl.
CPC ..... *A41B 13/103* (2013.01); *A41B 13/106* (2013.01)

(58) Field of Classification Search
CPC ..... A41B 13/10; A41B 13/103; A41B 13/106
USPC ..... D2/863, 864
See application file for complete search history.

(56) References Cited

U.S. PATENT DOCUMENTS 615,293 A * 12/1898 Maier ..... A41B 13/103 2/49.2
1,284,252 A * 11/1918 Dalton ..... A41B 13/103 2/49.3
1,592,283 A * 7/1926 Mckenzie ..... A61B 46/00 2/48
1,692,951 A * 11/1928 Pinckney ..... B65D 5/008 383/120
2,643,384 A * 6/1953 Thompson ..... A41B 13/106 2/49.3
3,407,407 A * 10/1968 Smith ..... A41B 13/103 D2/864
4,301,544 A * 11/1981 Burton ..... A41B 13/106 2/49.5
4,649,572 A * 3/1987 Roessler ..... A41B 13/103 2/49.4
4,779,288 A * 10/1988 Mack ..... A41B 13/103 2/49.3
5,218,721 A * 6/1993 Mathews ..... A41B 13/103 2/244
5,504,941 A * 4/1996 Sell ..... A41B 13/103 2/46

(Continued)

*Primary Examiner* — Heather Mangine
(74) *Attorney, Agent, or Firm* — DP IP GROUP; Franco S. De Liguori

(57) ABSTRACT

A bib has a main body with a front surface and a pouch provided at a lower end of the main body contiguous with the front surface for collecting solids and/or liquids dropped by the user during use of the bib. The main body is provided with first connecting members at an upper end for removably connecting the bib around the user's neck. The pouch is provided with second connecting members for removably connecting the pouch to a connecting surface during use of the bib. The bib is provided with means for facilitating attachment of the pouch to the connecting surface by the second connecting members during use of the bib by allowing the pouch to extend out and be maintained open and in a proper orientation for collecting dropped solids and/or liquids.

21 Claims, 15 Drawing Sheets

(56) References Cited

U.S. PATENT DOCUMENTS

| | | | | | |
|---|---|---|---|---|---|
| 5,829,627 | A * | 11/1998 | Martindale | A47G 23/0303 | 220/666 |
| 6,105,165 | A * | 8/2000 | Johnson | A41B 13/103 | 2/48 |
| 6,789,265 | B1 * | 9/2004 | Vonrinteln | A41B 13/103 | 2/48 |
| D540,511 | S * | 4/2007 | Toomer | D2/864 | |
| D917,131 | S * | 4/2021 | Cannon | D2/864 | |
| 2002/0004945 | A1 * | 1/2002 | Kaloustian | A41B 13/106 | 2/49.3 |
| 2007/0157357 | A1 * | 7/2007 | Cymbol | A41B 13/103 | 2/49.2 |
| 2008/0172768 | A1 * | 7/2008 | DeStefano | A41B 13/106 | 2/48 |
| 2015/0135391 | A1 * | 5/2015 | Chandler | A41B 13/106 | 2/49.2 |
| 2017/0303602 | A1 * | 10/2017 | Petersen | A47G 19/08 | |
| 2018/0220715 | A1 * | 8/2018 | Bisson | A41B 13/103 | |
| 2019/0133204 | A1 * | 5/2019 | Martone Cardinale | B32B 7/12 | |
| 2019/0174838 | A1 * | 6/2019 | D'Amato-Friedman | A41B 13/103 | |
| 2019/0223518 | A1 * | 7/2019 | Schutte | A41B 13/10 | |
| 2020/0138120 | A1 * | 5/2020 | Brazdo | A41B 13/10 | |
| 2020/0196682 | A1 * | 6/2020 | Chuah | A44B 17/0076 | |
| 2022/0400778 | A1 * | 12/2022 | Lee | A47D 15/00 | |
| 2023/0000183 | A1 * | 1/2023 | Markel | A41B 13/103 | |
| 2023/0172285 | A1 * | 6/2023 | Wu | A41B 13/103 | 2/49.2 |
| 2024/0099397 | A1 * | 3/2024 | Fynbo | A41B 13/103 | |
| 2024/0358093 | A1 * | 10/2024 | McCurry | A41B 13/103 | |

* cited by examiner

BIB

RELATED APPLICATION

This application claims the benefit of U.S. Provisional Patent Application No. 63/461,715, filed Apr. 25, 2023.

BACKGROUND

Technical Field

The present invention relates generally to bibs and, more particularly, to bibs for protecting individuals using the bibs from solids and liquids which may be dropped during drinking and/or eating.

Background Information

Bibs have been used for a very long time to protect the wearer's body/clothing when eating and/or drinking. Bibs come in many different forms, shapes, and sizes and they generally are snapped, buttoned, fastened, or tied around the wearer's neck so that the bib hangs flat on the wearer's chest. Bibs also come in a cloth or waterproof/water resistant type of fabric that protects a certain portion of the wearer's clothing from getting wet or stained. Many different shapes also exist some of the more popular shapes include a pocket or pouch attached at the base of the bib to help capture/collect food pieces that are dropped from a wearer's utensil/hand/mouth.

Some common problems exist with these currently available bibs. Having a pouch at the base of the bib is meant to protect the wearer's lap from getting messy from the dropped food particles, but food doesn't always drop into the pouch as the pouch extends out only a minimal amount and doesn't always stay open. Since the wearer is generally an unskilled eater, food generally gets dropped from a utensil before it even reaches the wearer's mouth, causing the food to completely miss the pouch. Messes are inevitable in these circumstances, as the food bits will land on the wearer's clothing, in their lap, and/or on the floor underneath them staining whatever it contacts. Another issue is the bib's length—most bibs currently available only drop down to the wearer's upper to mid torso, which can pose problems when the wearer is seated at a table and/or highchair because the tray or table could push against the pouch at the base of the bib causing the pouch to close. These bibs also are not wide enough at the base to capture/collect food pieces that are dropped on either side of the bib causing the food to be dropped on the sides of the bib also staining the wearer's clothing or furniture underneath.

Another issue with these existing bibs is the width of the bib at the chest—most bibs currently available are too wide, causing the bib to buckle around the neck and chest area if it's not the appropriate size for the wearer when the wearer is putting their hands closer together or trying to bring food to their mouth. If the bib buckles, then it's not only uncomfortable for the wearer but it also lacks the effectiveness of preventing food/liquids from getting onto the chest and clothing underneath the bib because the buckling creates a gap between the neck and the bib. These bibs are also very uncomfortable in the neck area because the bib, which is typically made out of rough material, is in direct contact with the wearer's neck causing irritation.

Yet another issue with these existing bibs is cleanup when eating is done—(1) it's uncomfortable to bring the wearer all the way to the sink to get them cleaned up because either the bib is too dirty (causing food particles to spill/drop out of it) or bulky, or the wearer can't properly be cleaned in the neck area because the bib acts as a barrier, and (2) if the bib is removed upon cleanup, then the clothing underneath could get messy because there is nothing to protect it when wiping down or washing up the wearer's face and neck area.

Despite efforts to date to create a bib that helps capture food and the like with a pouch, a great need continues to exist for improved bib products that much more effectively capture dropped food and the like.

SUMMARY

The present invention provides bibs for protecting individuals using the bibs from solids and liquids, which may be dropped during drinking and/or eating.

In first aspect, a bib according to the present invention comprises a main body having a front surface, first connecting means provided at an upper end of the main body for removably connecting the bib around a user's neck, and a pouch provided at a lower end of the main body contiguous with the front surface for collecting solids and/or liquids dropped by the user during use of the bib. The pouch includes second connecting means for removably connecting the pouch to a connecting surface during use of the bib. The bib further comprises means for facilitating attachment of the pouch to the connecting surface by the second connecting means during use of the bib by allowing the pouch to extend out and be maintained open and in a proper orientation for collecting dropped solids and/or liquids.

As an example of the first aspect, the pouch is in the form of a trough-shaped structure including front, rear, bottom, and side sections.

In one embodiment of the first aspect, the means for facilitating attachment comprises a folding portion formed by an upper end portion of the front section of the pouch and a pair of slits formed at respective intersections between the front section and the side sections of the pouch to enable the folding portion to be bent or folded along a folding line in a direction of the connecting surface. The second connecting means is provided on the folding portion of the pouch.

In another embodiment of the first aspect, the means for facilitating attachment comprises each of the side sections of the pouch being provided with a pleated structure configured to facilitate movement of the front section of the pouch in the direction of the connecting surface for removably attaching the second connecting means to the connecting surface. The second connecting means is provided on the front section of the pouch.

In yet another embodiment of the first aspect, the means for facilitating attachment comprises: a folding portion formed by an upper end portion of the front section of the pouch and a pair of slits formed at respective intersections between the front section and the side sections of the pouch to enable the folding portion to be bent or folded along a folding line in a direction of the connecting surface; and each of the side sections of the pouch being provided with a pleated structure configured to facilitate movement of the front section of the pouch in the direction of the connecting surface for removably attaching the second connecting means to the connecting surface. The second connecting means is provided on the folding portion of the pouch.

In the foregoing embodiments of the first aspect, the second connecting means may comprise at least one suction cup. The bib may be formed as a one-piece, unitary structure made of a single piece of material, such as silicone.

In a second aspect, a bib according to the present invention comprises a main body having a main surface and provided with connection straps including connecting means for connecting the straps together to secure the bib around a user's neck. The connection straps have inner edges forming a neck receiving aperture shaped to fit the user's neck when the straps are connected together. The bib includes an extension section connected to and extending from the inner edges of the connection straps, the extension section being configured to overlap at least a portion of the main surface of the main body during use of the bib.

In the second aspect, the extension section may be connected to the inner edges of the connection straps by at least one of sewing, glue, and fusible bonding. The main body and extension section may be made of a fabric material.

In a third aspect, the present invention is directed to a bib structure formed by the combination of a first bib according to any of the embodiments of the first aspect and a second bib according to the second aspect. The extension section of the second bib is configured to overlap at least a portion of the front surface of the main body of the first bib during use of the bib structure. The first and second bibs are provided with connecting means for removably connecting the first and second bibs to one another.

These and other features and advantages of the present invention will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein:

In FIGS. 1-18, the same reference numerals denote the same elements.

DETAILED DESCRIPTION OF PREFERRED EMBODIMENTS

Figure 1:
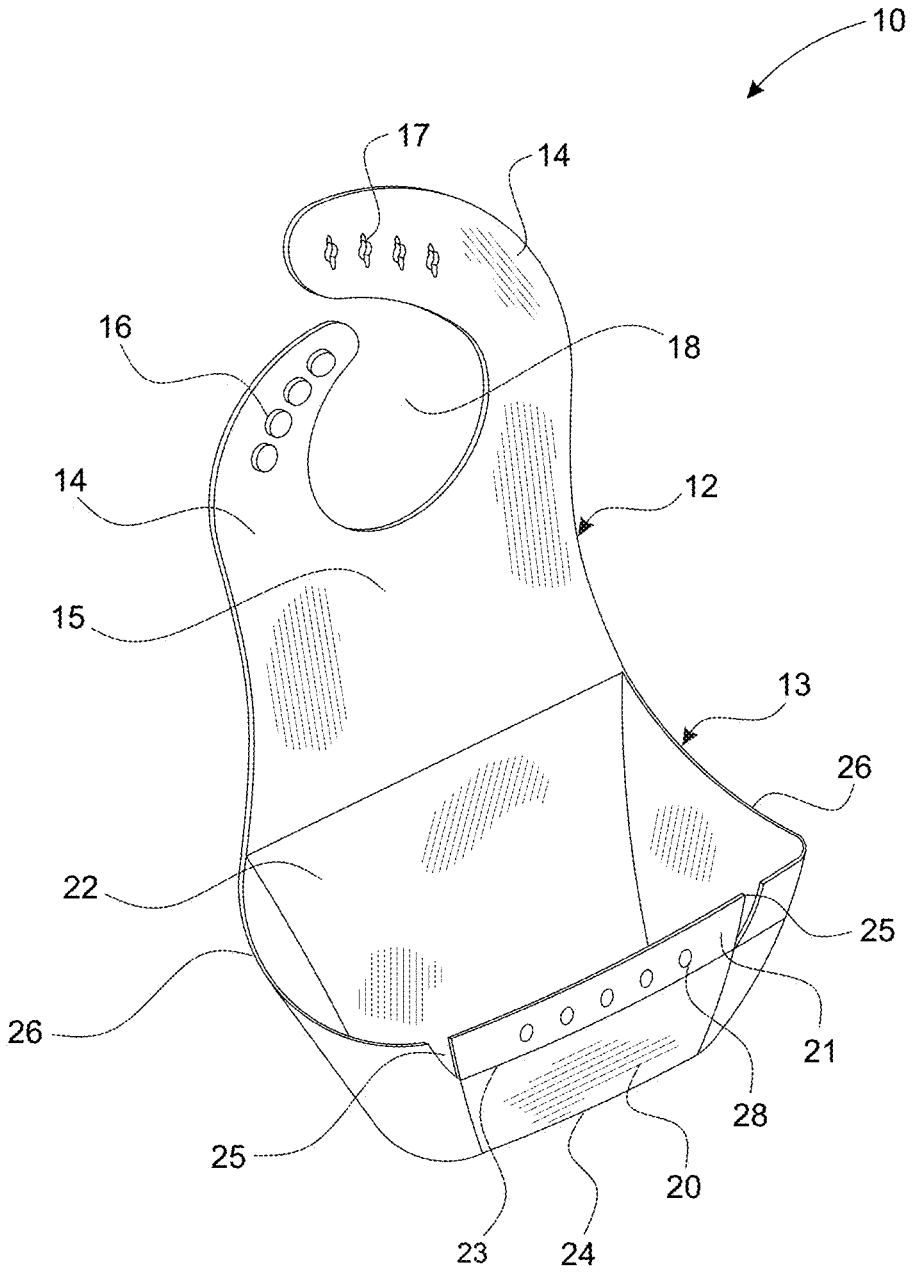
FIG. 1 is a perspective view of a bib according to an embodiment of the present invention.

It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention. The figures are intended for representative purposes only and should not be considered limiting in any respect. Throughout the drawings, the same reference numerals denote the same elements.

Embodiments of the present invention provide bibs with an improved structure including a catch device for catching dropped food or beverage so that the wearer's body/clothing and the floor underneath them is protected in ways beyond the methods currently achieved by existing bibs.

The bibs according to the various embodiments of the present invention are primarily described herein for use by infants. It is understood, however, that the bibs of the present invention are also suitable for use by adults, such as elderly people, as well as by individuals with special needs of all ages.

Referring to FIG. 1, there is shown a bib, generally designated with numeral 10, according to one embodiment of the present invention. Bib 10 includes an apron-like section or main body 12 with a front surface 15, and a pouch 13 disposed at a lower end of main body 12 and contiguous with front surface 15. An upper end of main body 12 has straps 14 provided with first connecting means 16, 17 for removably connecting together straps to attach bib 10 to an infant. In this embodiment, pouch 13 is in the form of a trough-shaped structure including front 20, rear 22, bottom or base 24, and side 26 sections. Pouch 13 is configured for catching solids and liquids dropped by the infant during use of bib 10. This effectively protects the floor and the infant's clothing from dropped food and liquids.

In this embodiment, first connecting means 16, 17 are in the form of male 16 and female 17 fasteners for removably connecting straps 14 to one another to form a neck receiving aperture 18 for securing bib 10 around the neck of the infant. When connected together using first connecting means 16, 17, straps 14 (and corresponding aperture 18) are configured to fit around the user's neck during use of bib 10. Other types of fasteners may be selected for first connecting means 16, 17 without departing from the scope of the present invention, including hook and loop fasteners, snap fasteners, and other suitable attachment means.

Front section 20 of pouch 13 includes an upper end portion 21. According to a feature of the embodiment of the present invention shown in FIG. 1, upper end portion 21 of pouch 13 is a folding portion configured to be bent or folded along a folding line 23. To facilitate bending of folding portion 21 along folding line 23, pouch 13 is further provided with a pair of slits 25 formed at respective intersections between front section 20 and side sections 26, as shown in FIG. 1. Stated otherwise, slits 25 enable folding portion 21 to be bent or folded along folding line 23. Folding portion 21 is provided with second connecting means 28 for removably connecting, securing, or attaching pouch 13 to a surface during use of bib 10, such as a highchair tray or table.

In an example of the present embodiment, second connecting means 28 comprise suction cups. However, other attachment devices may be used, such as hook and loop fasteners or other similar types of fastening device known in the art for easy attachment and detachment of pouch 13 to the surface during use of bib 10. Although FIG. 1 illustrates five attachment devices as the second connecting means 28, it is understood that the number of attachment devices can be varied so long as the type and number of attachment device(s) selected are sufficient to securely removably connect pouch 13 to the connecting surface. For example, second connecting means 28 can be in the form of at least one suction cup with sufficient connecting (suction) force when removably connected to the connecting surface.

According to the present invention, during use of pouch 13, slits 25 permit folding portion 21 to be readily folded towards the connecting surface (e.g., highchair tray or table) to facilitate attachment of suctions cups 28 to the connecting surface. This can be advantageously achieved without the generation of an unwanted pull on pouch 13, and bib 10 in general, when suction cups 28 are attached to the connecting surface, thereby preventing discomfort to the infant wearing bib 10. When suction cups 28 are attached to the connecting surface, folding portion 21 and slits 25 also permit pouch 13 to be maintained open and in a proper orientation relative to main body 12 and the connecting surface so that solids and/or liquids dropped by the infant during use of bib 10 can be effectively caught and retained by pouch 13 during use of bib 10. As such, folding portion 21 and slits 25 of pouch 13 constitute means for facilitating attachment of pouch 13 to a connecting surface during use of bib 10 without generating discomfort on a user of bib 10 by allowing pouch 13 to extend out and be maintained open and in a proper orientation during use of bib 10 for collecting solids and/or liquids which may be dropped by the user.

In the present embodiment, bib 10, including main body 12 and pouch 13, is an integral, one-piece, unitary structure made of a single piece of material. In one example of the present embodiment, bib 10 can be made of a flexible material, such as silicone. Alternatively, bib 10 can be made of a rigid or substantially rigid material, such as a rigid molded plastic material. In an alternative embodiment, main body 12 and pouch 13 can be formed as separate structures (i.e., two different pieces) which can be connected together using suitable connecting means to form an integrated structure.

In the embodiment of FIG. 1, folding portion 21 with second connecting means 28 and corresponding folding line 23 are provided on the upper end of front section 20 of pouch 13. It is understood, however, and without departing from the scope of the present invention, that folding portion 21 with second connecting means 28 and corresponding folding line 23 can alternatively, or additionally, be provided on a lower end of front section 20, or on one or more of upper, lower or any portion of other sections of pouch 13, including the bottom 24 and side 26 sections, for example. Additionally, although in FIG. 1 second connecting means 28 (e.g., suction cups) are shown positioned on folding portion 21 along a general line in a width direction of pouch 13, it is understood that second connecting means 28 can be arranged in any orientation and/or direction provided that they are able to securely removably attach pouch 13 to the connecting surface (e.g., highchair tray or table).

By the foregoing construction, bib 10 is particularly designed so that pouch 13 effectively captures/collects liquid and/or food pieces that are dropped from a wearer's utensil/hand/mouth, thereby protecting the wearer's clothing and body from getting messy. Specifically, when pouch 13 is mounted to a surface (e.g., highchair or table) using connecting means 28 as described above, folding portion 21 and corresponding slits 25 allow pouch 13 to sufficiently extend out and always stay open, without compromising the required collecting position for pouch 13, so that dropped liquids, food particles and the like can be effectively captured by pouch 13.

Bib 10, including pouch 13 and corresponding construction, significantly reduces the likelihood of liquids, food particles and the like falling onto the infant's body and clothing as well as the floor. Pouch 13 also provides an extended eating area that keeps food within the infant's eating proximity. This promotes better eating habits for the infant.

Figure 2:
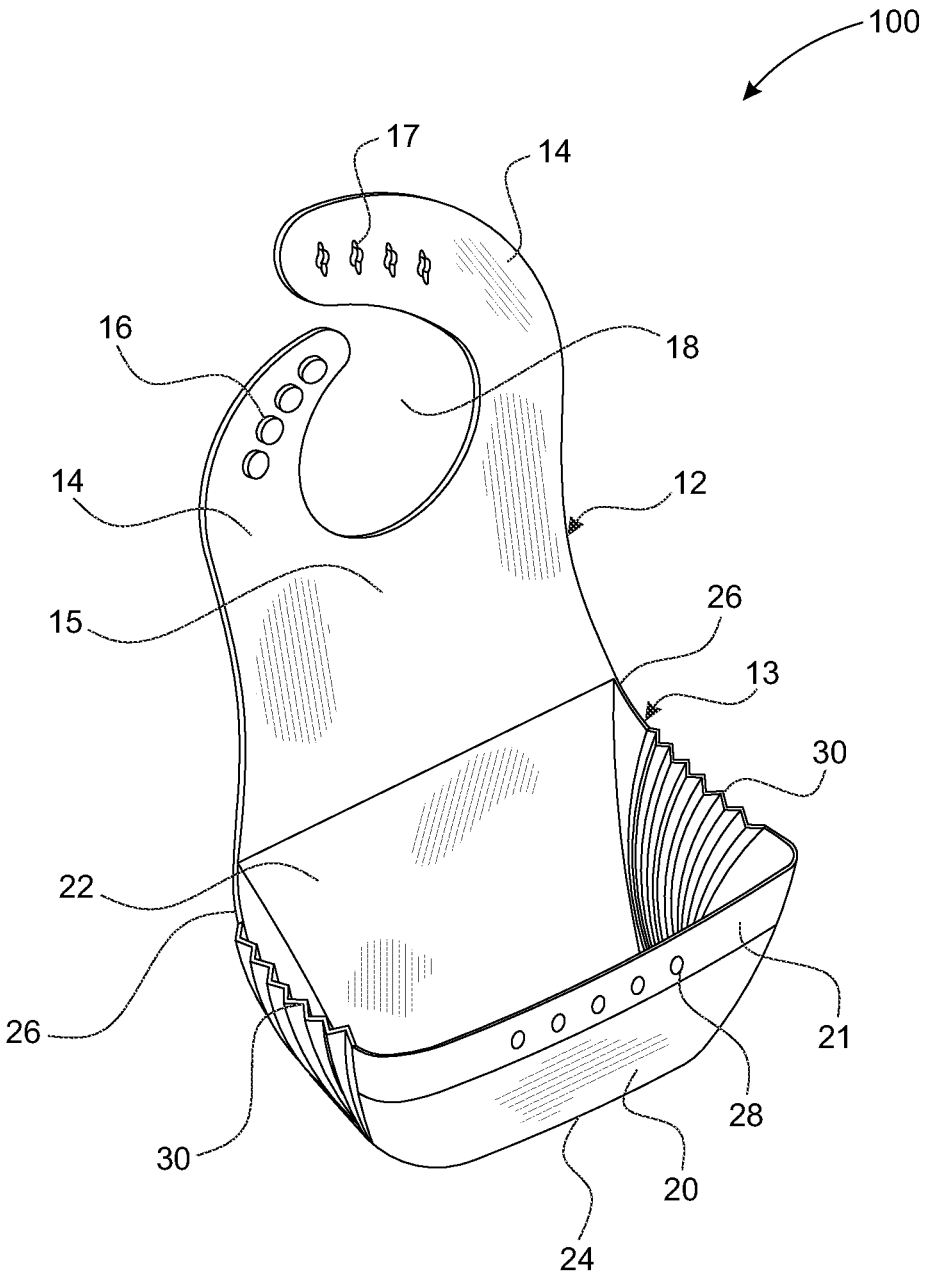
FIG. 2 is a perspective view of a bib according to another embodiment of the present invention.

FIG. 2 shows another embodiment of the bib, generally designated with reference numeral 100, according to the present invention. Bib 100 is a modified form of bib 10 in FIG. 1. The same numerals in FIGS. 1 and 2 denote the same elements.

In bib 10 described above with reference to FIG. 1, the means for facilitating attachment of pouch 13 to a connecting surface during use of bib 10 comprises upper end portion 21 of pouch 13 being formed as a folding portion and further including slits 25 to facilitate folding or bending of folding portion 21 about folding line 23. On the other hand, bib 100 in FIG. 2 does not include a folding line and corresponding slits. Instead, in FIG. 2 the means for facilitating attachment of pouch 13 to a connecting surface during use of bib 100 comprises each side section 26 of pouch 13 being provided with a pleated structure 30 configured to facilitate movement of front section 20 of pouch 13 in the direction of the connecting surface for removably attaching second connecting means 28 (e.g., suction cups) to the connecting surface. Pleated structure 30 constitutes means for facilitating attachment of pouch 13 to a connecting surface during use of bib 10 without generating discomfort on a user of bib 10 by allowing pouch 13 to extend out and be maintained open and in a proper orientation during use of bib 10 for collecting solids and/or liquids which may be dropped by the user.

By the foregoing construction, bib 100 is particularly designed so that pouch 13 effectively captures/collects liquid and/or food pieces that are dropped from a wearer's utensil/hand/mouth, thereby protecting the wearer's clothing and body from getting messy. Specifically, when pouch 13 is mounted to a surface (e.g., highchair or table) using connecting means 28 as described above, pleated structure 30 allows pouch 13 to sufficiently extend out and always stay open, without compromising the required collecting position for pouch 13, so that dropped liquids, food pieces and the like can be effectively captured by pouch 13.

Figure 3:
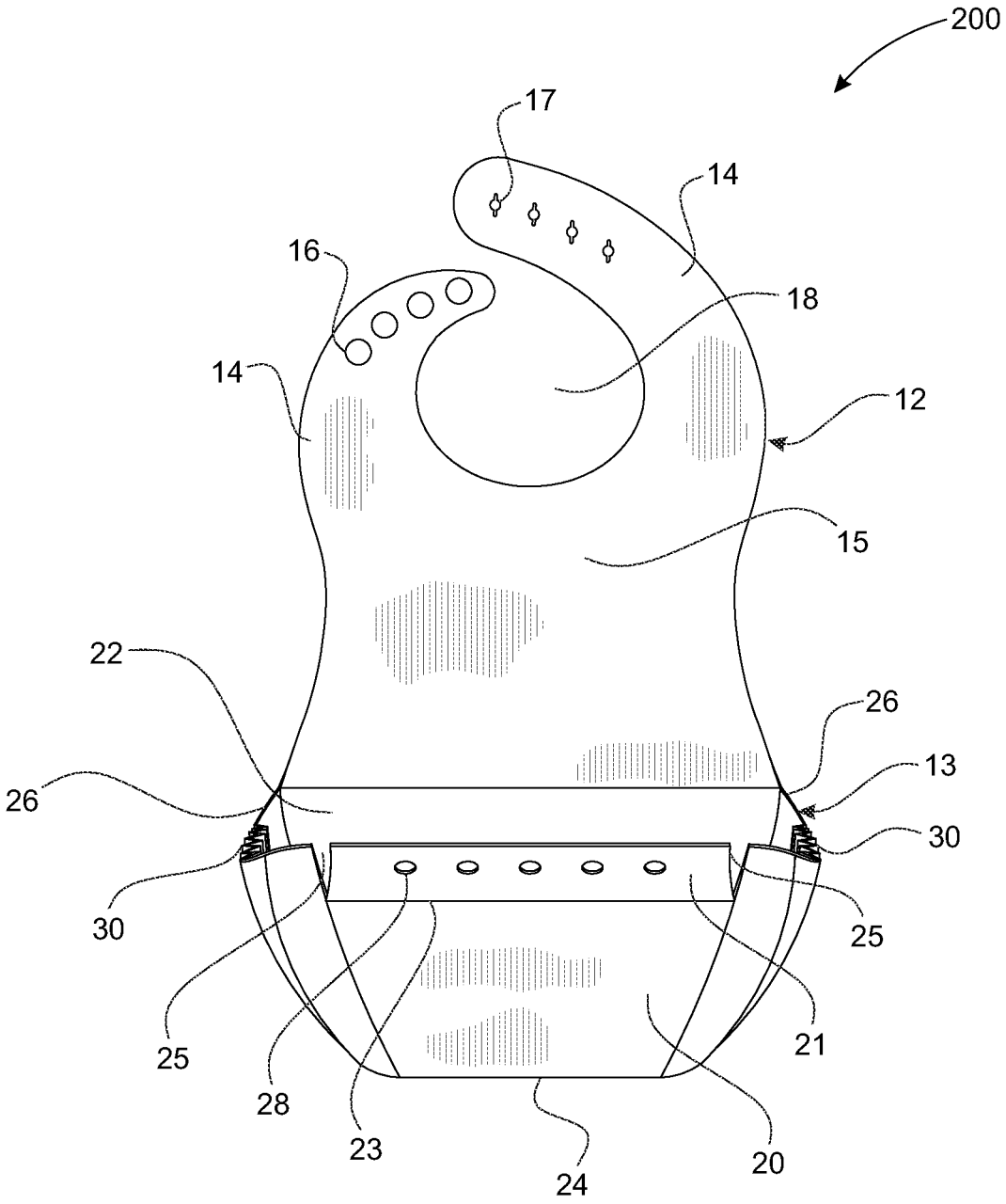
FIG. 3 is a perspective view of a bib according to another embodiment of the present invention.

FIG. 3 shows another embodiment of the bib, generally designated with reference numeral 200, according to the present invention. Bib 100 is a modified form of bib 10 in FIG. 1 and bib 100 in FIG. 2. The same numerals in FIGS. 1-3 denote the same elements.

Bib 200 in FIG. 3 differs from the bibs described above with reference to the embodiments of FIGS. 1 and 2 in that pouch 13 of bib 200 is provided with folding portion 21 and corresponding slits 25 for facilitating folding or bending of folding portion 21 along folding line 23, as described above for bib 10 of FIG. 1, and side sections 26 are provided with pleated structure 30 for further facilitating movement of front section 20 in the direction of the connecting surface for removably attaching second connecting means 28 (e.g., suction cups) to the connecting surface, as described above for bib 100 of FIG. 2. All features and advantages of bib 200 are as described above for bib 10 and bib 100 with reference to FIGS. 1 and 2, respectively.

Figure 6:
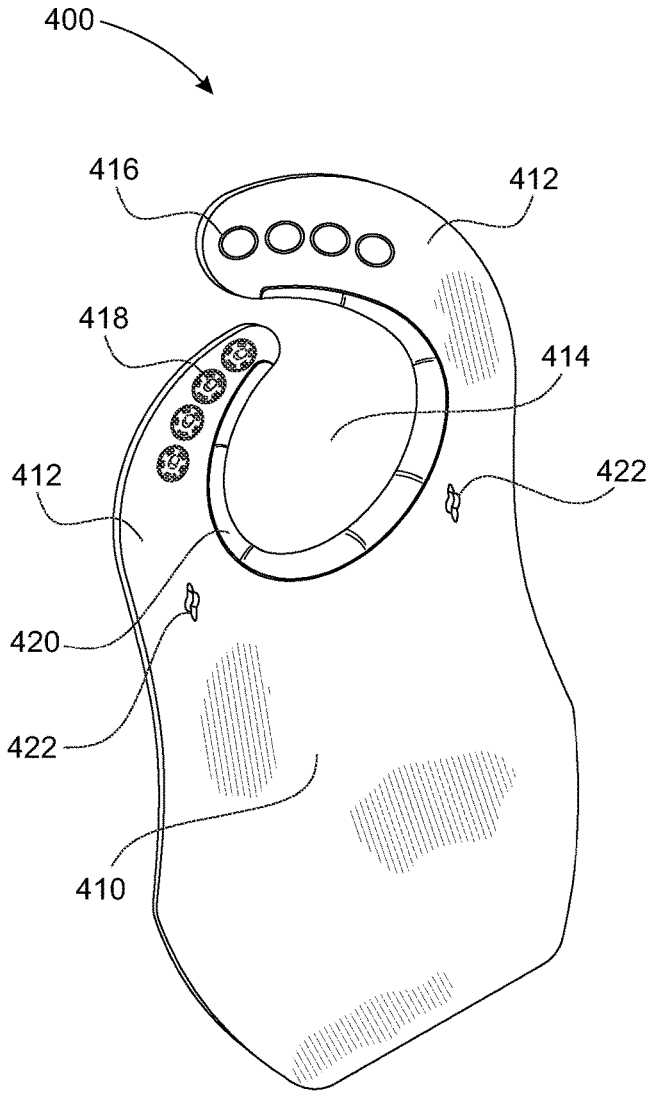
FIG. 6 is a perspective view of bib according to another embodiment of the present invention.
Figure 7:
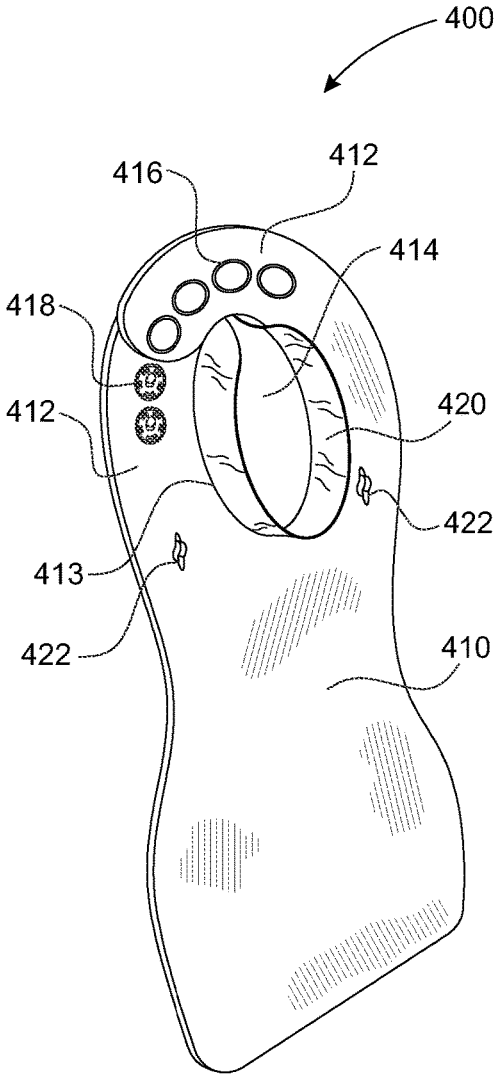
FIG. 7 is another perspective view of the bib shown in FIG. 6.

FIGS. 6-7 show another embodiment of a bib, generally designated at 400, according to the present invention.

Bib 400 includes an apron-like member or main body 410, connection straps 412 having inner edges 413, and a neck receiving aperture 414 formed by inner edges 413 of straps 412 when connected together as shown in FIG. 7. Straps 412 includes connecting means 416, 418 adapted for securing bib 400 around the neck of an infant for use during eating and/or drinking to prevent, or substantially reduce, the likelihood of the baby being soiled while eating and/or drinking. In this embodiment, connecting means 416, 418 are fasteners in the form of snap connectors. However, other types of connecting means are suitable, such as hook and loop fasteners.

According to a feature of the present invention, bib 400 includes a bib extension section 420 connected to and extending from inner edges 413 of straps 412. Extension section 420 is configured to extend over or overlap at least a portion of the surface of main body 410 to provide additional protection to the baby from being soiled while eating and/or drinking. Bib 400 and extension section 420 may be made of any suitable fabric material, such as cotton. Bib 400 can also be made of a waterproof/water resistant type of fabric that protects the infant's clothing from getting wet or stained. Extension section 420 can be connected to inner edges 413 of straps 412 by at least one of sewing, glue, and fusible bonding, for example. The length of extension section 420 and corresponding degree of extension along the surface of main body 410 can be varied without departing from the scope of the present invention.

According to the present invention, bib 400 can be used alone or in combination with any of bibs 10, 100, 200 described above with reference to FIGS. 1-3, respectively. To facilitate use of bib 400 in combination with any of bibs 10, 100, 200, bib 400 is further provided with connecting means 422, as shown in FIGS. 6-7, for removable connection to any of bibs 10, 100, 200 as further described below.

Figure 4:
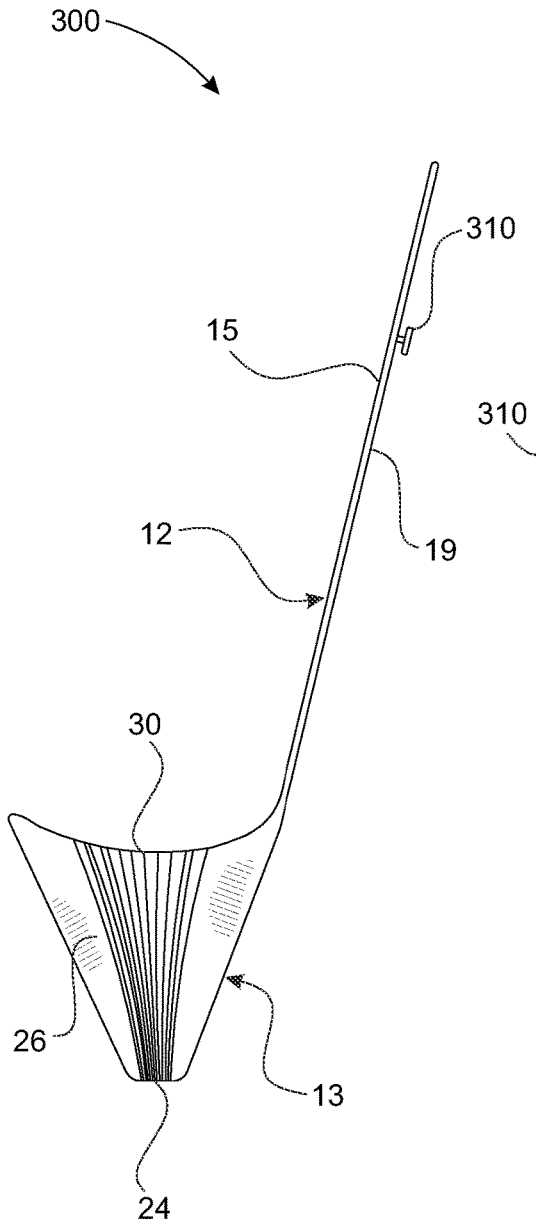
FIG. 4 is a side view of a bib according to another embodiment of the present invention.
Figure 5:
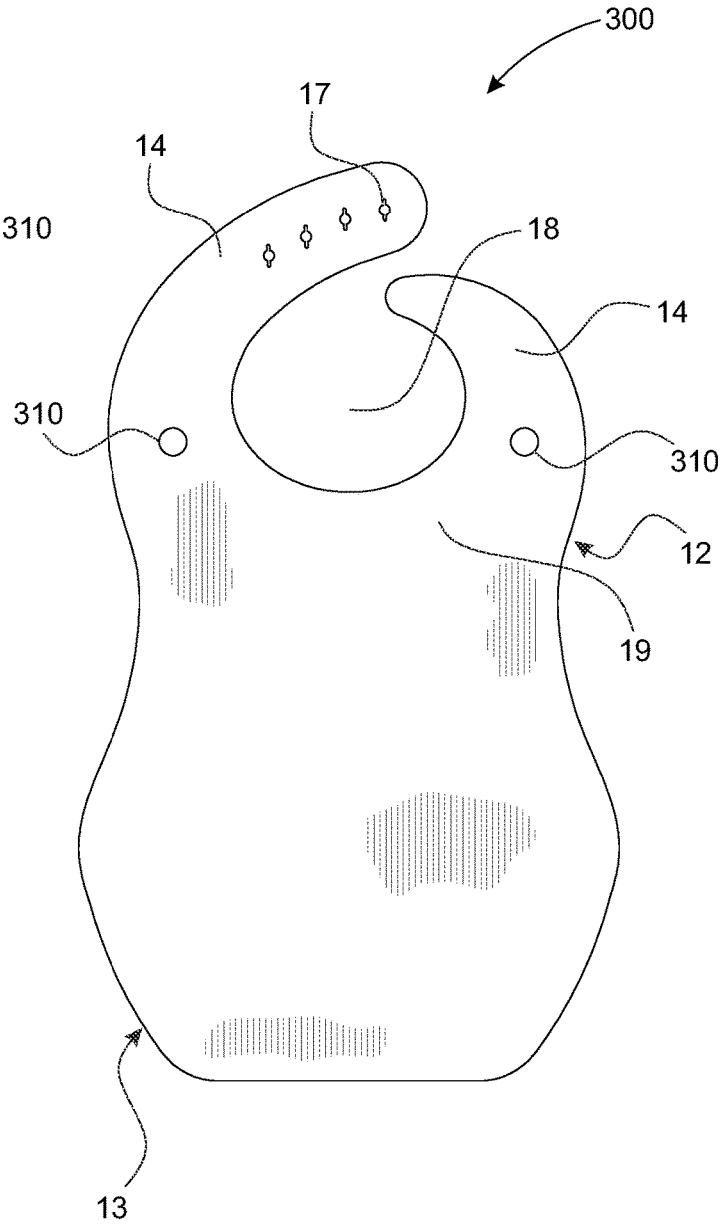
FIG. 5 is a rear view of the bib shown in FIG. 4.

FIGS. 4-5 and 8-9 show an exemplary embodiment of a bib structure in which bib 400 (second bib) is combined with bib 200 (first bib) described above with reference to FIG. 3. In FIGS. 4-5, the bib is designated with reference numeral 300 and differs from bib 200 as further described below. The bib structure formed of the combination of bib 400 with bib 300 is denoted with reference numeral 500 in FIGS. 8-9. Although bib 400 is described and illustrated in combination with bib 200 only, it is understood that bib 400 is also equally adapted for use in combination with bibs 10 and 100 without departing from the scope of the present invention.

The only difference between bib 300 shown in FIGS. 4-5 and bib 200 shown in FIG. 3 is that bib 300 is further provided with connecting means 310 for removable engagement with connecting means 422 of bib 400 to removable secure bibs 300 and 400 together during use. Connecting means 310 are formed on a rear surface 19 of bib 300 at preselected positions enabling their corresponding removable connection to connecting means 422 of bib 400. In this embodiment, connecting means 310 are male connectors and connecting means 422 are female connectors configured to removably receive the male connectors. Alternatively, bib 300 can be provided with female connectors and bib 400 can be provided with corresponding male connectors. Furthermore, each of connecting means 310, 422 may be in the form of a single connector or multiple connectors provided that a suitable removable connection is achieved between bibs 300 and 400. Other forms and quantity of connectors are suitable for removably connecting bibs 300 and 400 with departing from the scope of the present invention.

Figure 8:
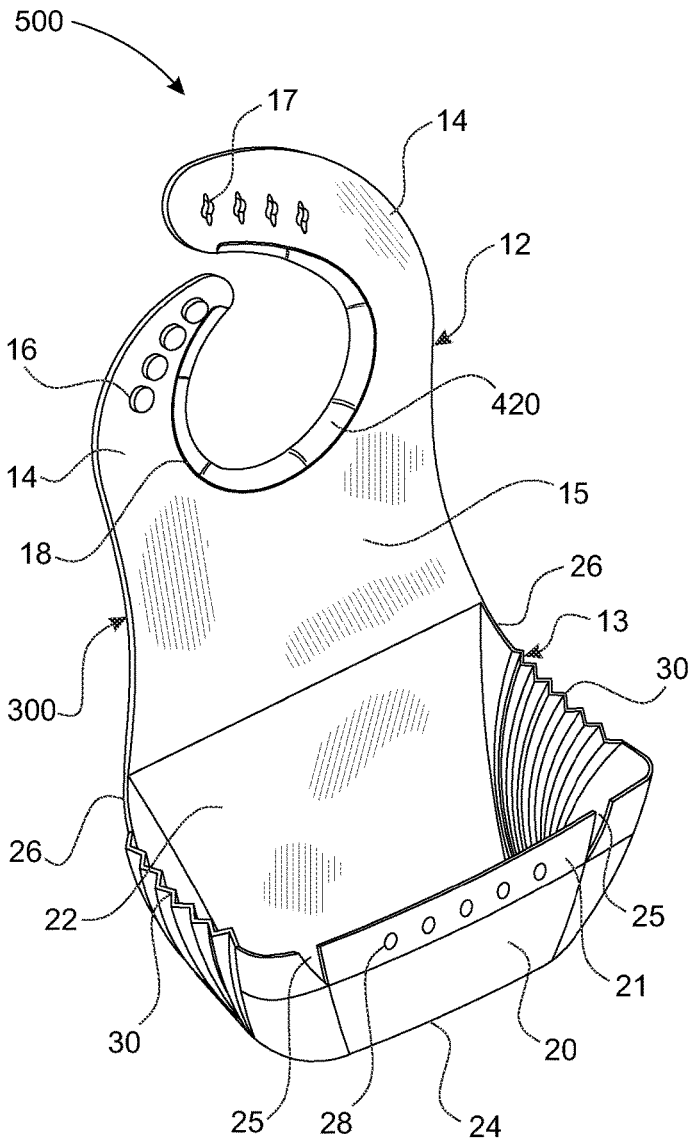
FIG. 8 is a perspective view of a bib structure incorporating the bib shown in FIGS. 6-7 with the bib shown in FIGS. 4-5, in accordance with an embodiment of the present invention.
Figure 9:
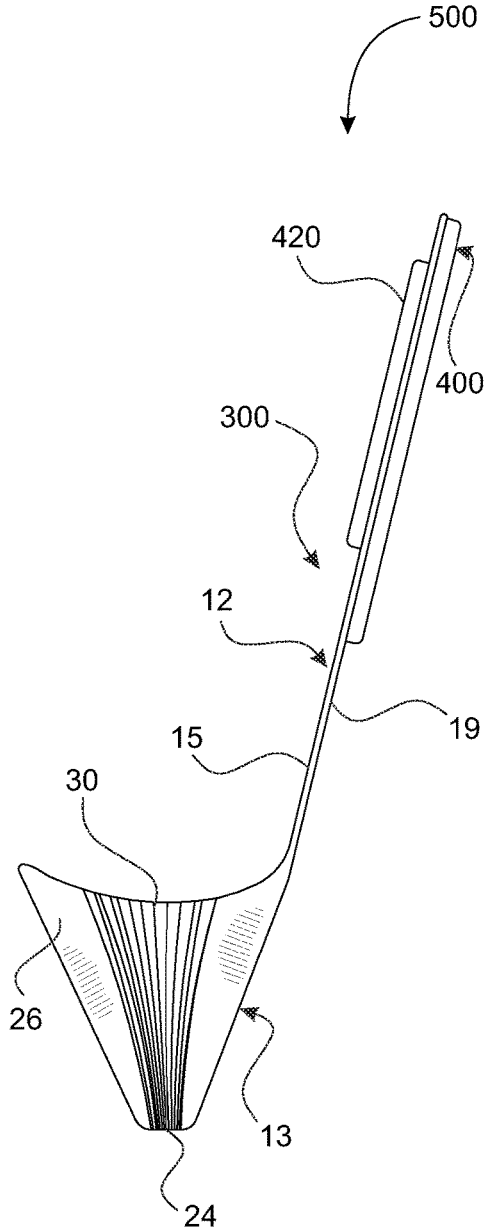
FIG. 9 is a side view of the bib structure shown in FIG. 8.

FIGS. 8-9 illustrate the bib structure 500 formed by the removable connection between bib 300 of FIGS. 4-5 and bib 400 of FIGS. 6-7.

Bibs 300 and 400 can be readily connected or assembled together as shown in FIGS. 8-9 by the releasable engagement between connecting means 310 of bib 300 and connecting means 422 of bib 400. In this connected configuration, the main body 410 of bib 400 is positioned to overlap at least a portion of rear surface 19 of bib 300 while extension section 420 of bib 400 is passed through aperture 18 of bib 300 so that extension section 420 is positioned to extend over and overlap at least a portion of front surface 15 of bib 300. It is understood that the degree in which extension section 420 of bib 400 extends over and overlaps front surface 15 of bib 300 can be varied by the selection of a desired length for extension section 420. For example, the length of extension section 420 can be selected so that extension section 420 overlaps a substantial area of front surface 15 of bib 300, including extension section 420 being configured long enough to extend at least partially into pouch 13.

Bib structure 500 can be assembled before or after it is mounted on an infant. For example, bibs 300 and 400 can be first connected together using connecting means 310 and 422 as described above and, while connected to one another, each of bib 300 and bib 400 can be selectively fastened or tied around the infant's neck using the corresponding connecting means 16, 17 for bib 300 and connecting means 416, 418 for bib 400. In this case, prior to fastening or tying bib 400 around the infant's neck, main body 410 is positioned to overlap at least a portion of rear surface 19 of bib 300 while extension section 420 of bib 400 is passed through aperture 18 of bib 300 and positioned to extend over and overlap at least a portion of front surface 15 of bib 300. Alternatively, bib 400 can be first fastened or tied around the infant's neck using connecting means 416, 418. Thereafter, bib 300 is fastened or tied around the infant's neck using connecting means 16, 17 and over bib 400 so that main body 410 of bib 400 overlaps at least a portion of rear surface 19 of bib 300. Extension section 420 of bib 400 is then passed through aperture 18 of bib 300 and positioned to overlap at least a portion of front surface 15 of bib 300. Bibs 300 and 400 are then removably connected together using corresponding connecting means 310, 422.

Bib structure 500 provides additional benefits which further enhance the benefits provided by the bibs described above with reference to FIGS. 1-3. For example, when combined with bib 300 as described above, bib 400 further protects the infant's body and clothing from getting wet or stained while drinking and eating. Additionally, when bib 400 is made of a fabric material, bib 400 or extension section 420 can be conveniently used to wipe the infant's face and hands, for example, as a result of the infant getting wet or stained while eating and drinking.

The embodiments of bibs 10, 100, 200, 300, 400 and bib structure 500 described herein with reference to the drawings overcome the drawbacks of currently available bibs, including those described in the Background Information section of the present application, as noted below.

First, during use of the bibs and bib structure according to the embodiments of the present invention, pouch 13 will always stay open because it extends out just far enough for food to land inside pouch 13 without it buckling in and without it extending out too far so that food falls out of it. Connecting means 28 provided at front portion 20 of pouch 13 creates another layer that helps to keep the pouch open without it buckling in because it can be connected to a table or tray. In FIG. 2-5, 8-9, pleaded structure 30 configured on each side of pouch 13 creates yet another layer that helps to keep pouch 13 open the perfect amount because it facilitates movement of front section 20 when the wearer of the bib is moving back and forth while eating. These embodiments individually and together help to keep the wearer clean while eating, unlike the currently available bibs in the market that can't successfully accomplish what they were intended to do.

Second, when base 24 of bib 13 is configured to be longer than a table or tray with which the bib is being used, the table or tray will not push against front portion 20 and folding portion 21 of pouch 13 so as to close pouch 13 and cause food to drop on the wearer's lap. Together with connecting means 28 as well as pleaded structure 30, the longer length of base 24 will help avoid messes that occur from the bib's constant closure when it's pushed against a table or tray. This present invention will eliminate that currently existing hassle.

Third, base 24 of pouch 13 can be configured to be wider than bibs currently available in the market so that pouch 13 is wide enough to cover the wearer's lap. This will effectively prevent food and liquids from accidentally dropping out of pouch 13. The wider width of pouch 13 coupled with the longer length of base 24, connecting means 28, and pleaded structure 30 as described above create a unified embodiment that is bullet proof when it comes to avoiding messes. It is an invention that solves every issue that currently exists with current bibs.

Moreover, main body 12, including front surface 15, of the bibs and bib structure according to the present invention are configured to fit the wearer just right at the chest—it is not too wide, which, as a result, doesn't buckle at aperture 18 (e.g., neck) when worn by the wearer. This helps with comfort, and comfort is crucial for the wearer especially when first learning how to properly eat. If left uncomfortable, the wearer gets annoyed and stops eating all together in most cases which in turn frustrates the caregiver as well as the wearer. Also, because there is no buckling, food doesn't end up on the user's chest/neck area and clothing underneath staining everything it contacts. Furthermore, because the fit is good, the user's neck area will not get irritated because of the constant buckling and moving when the wearer is eating.

The bib structure 500, including bibs 300 and 400, according to the present invention also solves many of the problems described above with currently existing bibs, including the issue relating to cleanup when eating is done. According to the present invention, after eating is done bib 300 can be removed when the wearer is seated at the table, leaving the bib 400 on the wearer's neck. In a preferred embodiment, bib 400 is made of a soft fabric material and has a non-bulky construction so that it doesn't irritate the wearer's neck. Extension section 420 of bib 400 also serves as a barrier so food/liquids cannot access the user's neck area because extension section 420 is configured to fold over front surface 15 of big 300 when bib structure 500 is worn by the wearer. When the wearer is being wiped down or washed up at the sink, the wearer's clothing won't get dirty even if the bib 300 is removed because bib 400 protects the wearer's clothing, unlike traditional bibs—once removed, the clothing is exposed, which defeats the whole purpose of a bib because even if the wearer made it through the whole meal without staining their clothing, the cleanup will inevitably cause the mess.

FIGS. 10-18 show various additional embodiments of the bib according to the present invention. The bibs shown in the embodiments of FIGS. 10-18 include parts similar to the parts of the bib described above with reference to FIGS. 1-9, with the same reference numerals denoting the same elements.

Figure 10:
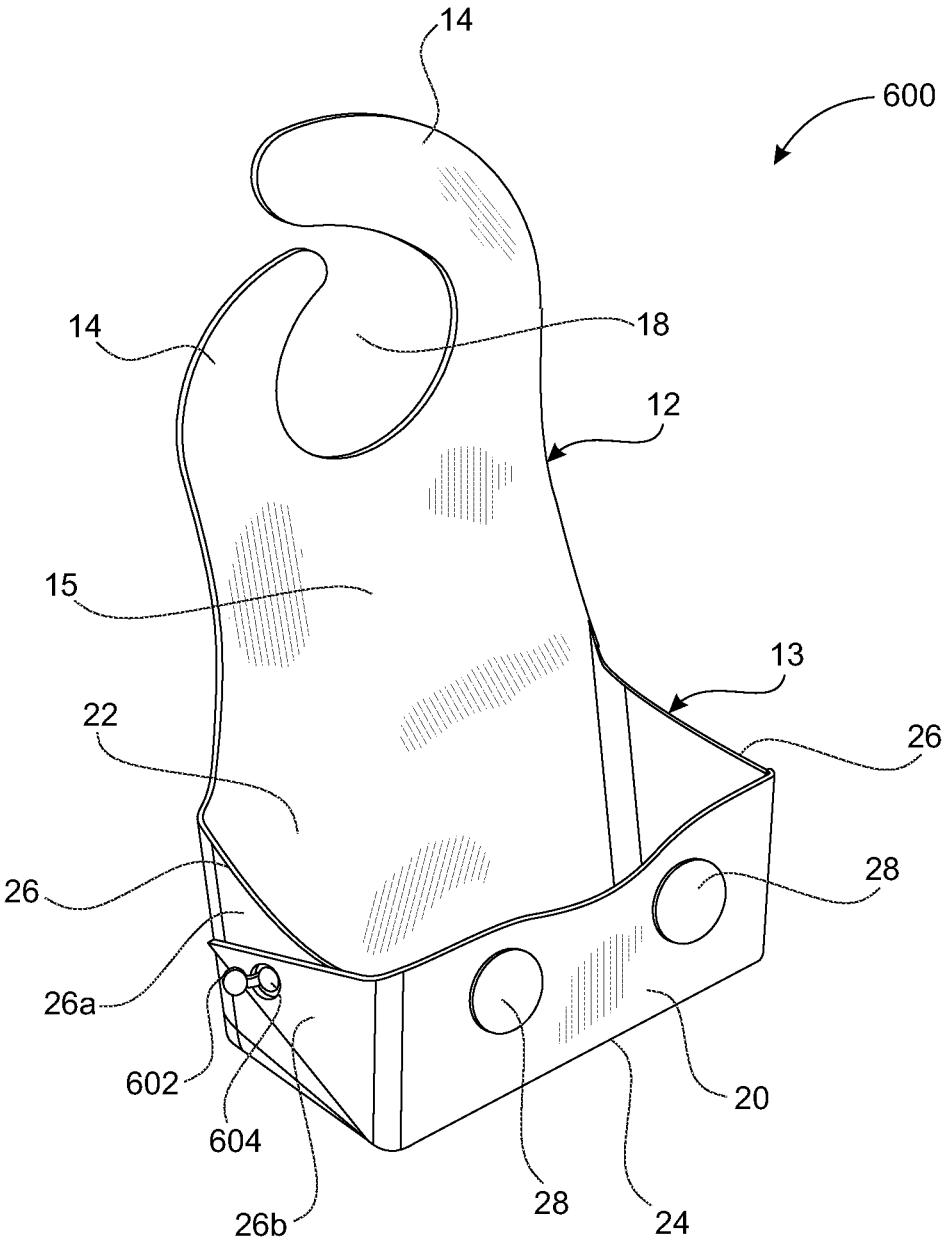
FIG. 10 is a perspective view of a bib according to another embodiment of the present invention.
Figure 11:
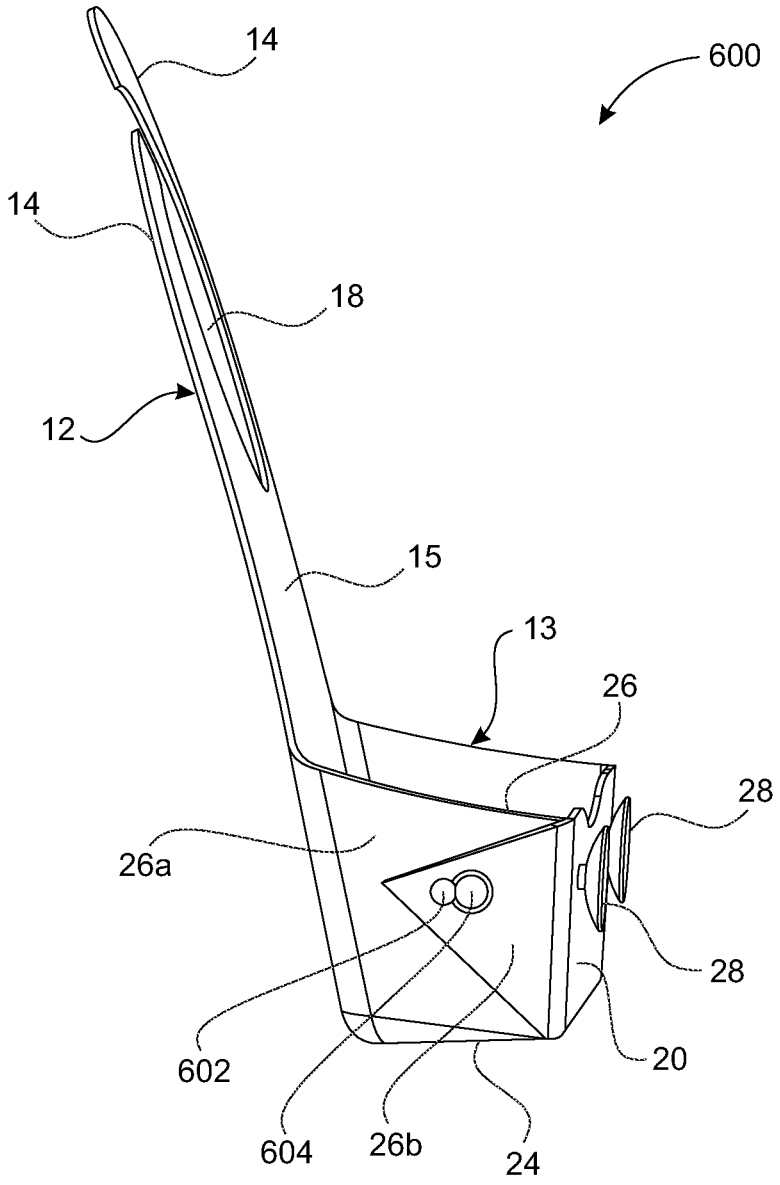
FIG. 11 is a side view of the bib shown in FIG. 10.
Figure 12:
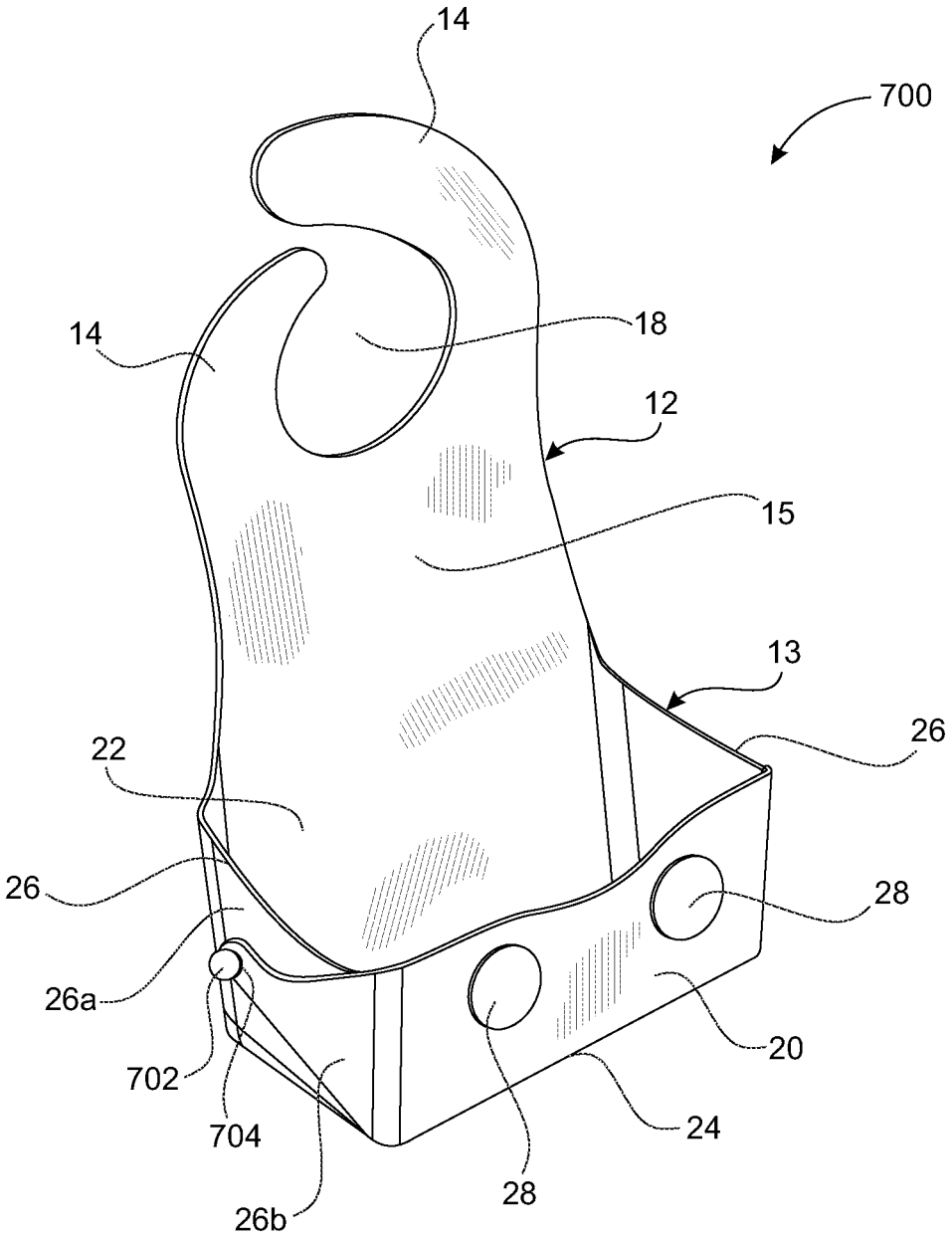
FIG. 12 is a perspective view of a bib according to another embodiment of the present invention.

FIGS. 10-11 show another embodiment of the bib, generally designated at 600, according to the present invention. In this embodiment, each side section 26 of bib 600 is formed of two side portions 26*a*, 26*b* configured to move (e.g., extend) relative one another to permit pouch 13 to be attached to a connecting surface during use of bib 600. Specifically, side portion 26*a* is provided with a pin structure 602 and side portion 26*b* is provided with two connecting holes 604 of different diameters as shown in the figures. In the configuration shown in FIGS. 11-12, pin structure 602 extends through the hole with the smaller diameter to hold side portion 26*b* in a non-extended state relative to side portion 26*a*. When side portion 26*b* is displaced relative to side portion 26*a* (i.e., to the left in FIG. 11), pin structure 602 is lined up with the larger diameter hole to permit side portion 26*b* to be released from pin structure 602 and permit side portion 26*b* to extend towards and be attached to a connecting surface using connecting means 28 which in this embodiment are in the form of suction cups, similar to the embodiment of FIG. 2, for example. In FIGS. 11-12 two suction cups are positioned on front section 20 of bib 600, however, the number and exact position of suction cups 28 can be varied without departing from the scope of the present invention. It will be appreciated that side portions 26*a*, 26*b*, pin structure 602 and holes 604 constitute means for facilitating attachment of pouch 13 to a connecting surface during use of bib 600 without generating discomfort on a user of bib 600 by allowing pouch 13 to extend out and be maintained open and in a proper orientation during use of bib 600 for collecting solids and/or liquids which may be dropped by the user.

Figure 13:
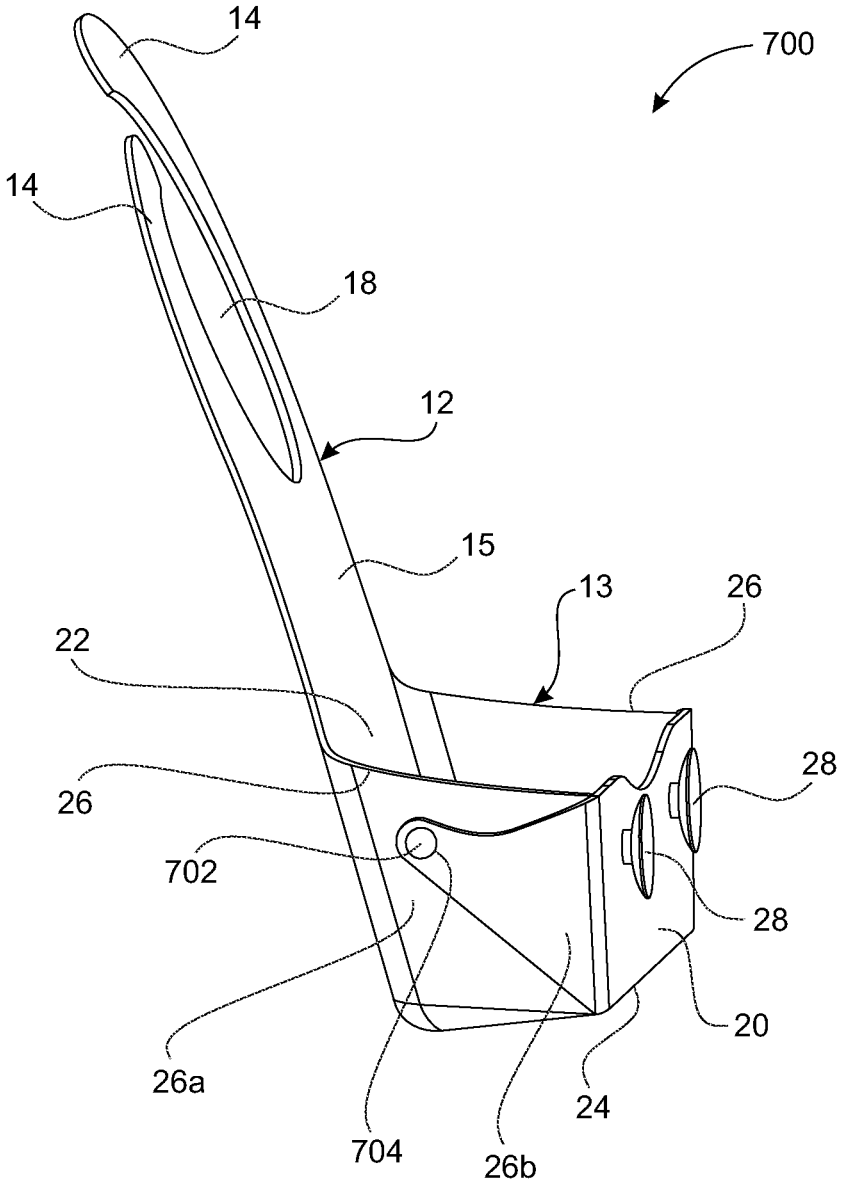
FIG. 13 is a side view of the bib shown in FIG. 12.

FIGS. 12-13 show another embodiment of the bib, generally designated at 700, according to the present invention. The construction of bib 700 is the same as for bib 600 described above with reference to FIGS. 10-11, except that side portion 26*b* of side section 26 is provide with only one hole 704 for receiving pin structure 702, instead of two holes for receiving pin structure 602 as shown in FIGS. 10-11. In the embodiment of FIGS. 12-13, side portion 26*b* is disconnected from side portion 26*a* by manually removing pin structure 702 from hole 704 to permit side portion 26*b* to be extended towards and be attached to a connecting surface using connecting means 28 (e.g., suction cups). It will be appreciated that in this embodiment side portions 26*a*, 26*b*, pin structure 702 and hole 704 constitute means for facilitating attachment of pouch 13 to a connecting surface during use of bib 700 without generating discomfort on a user of bib 700 by allowing pouch 13 to extend out and be maintained open and in a proper orientation during use of bib 700 for collecting solids and/or liquids which may be dropped by the user.

Figure 14:
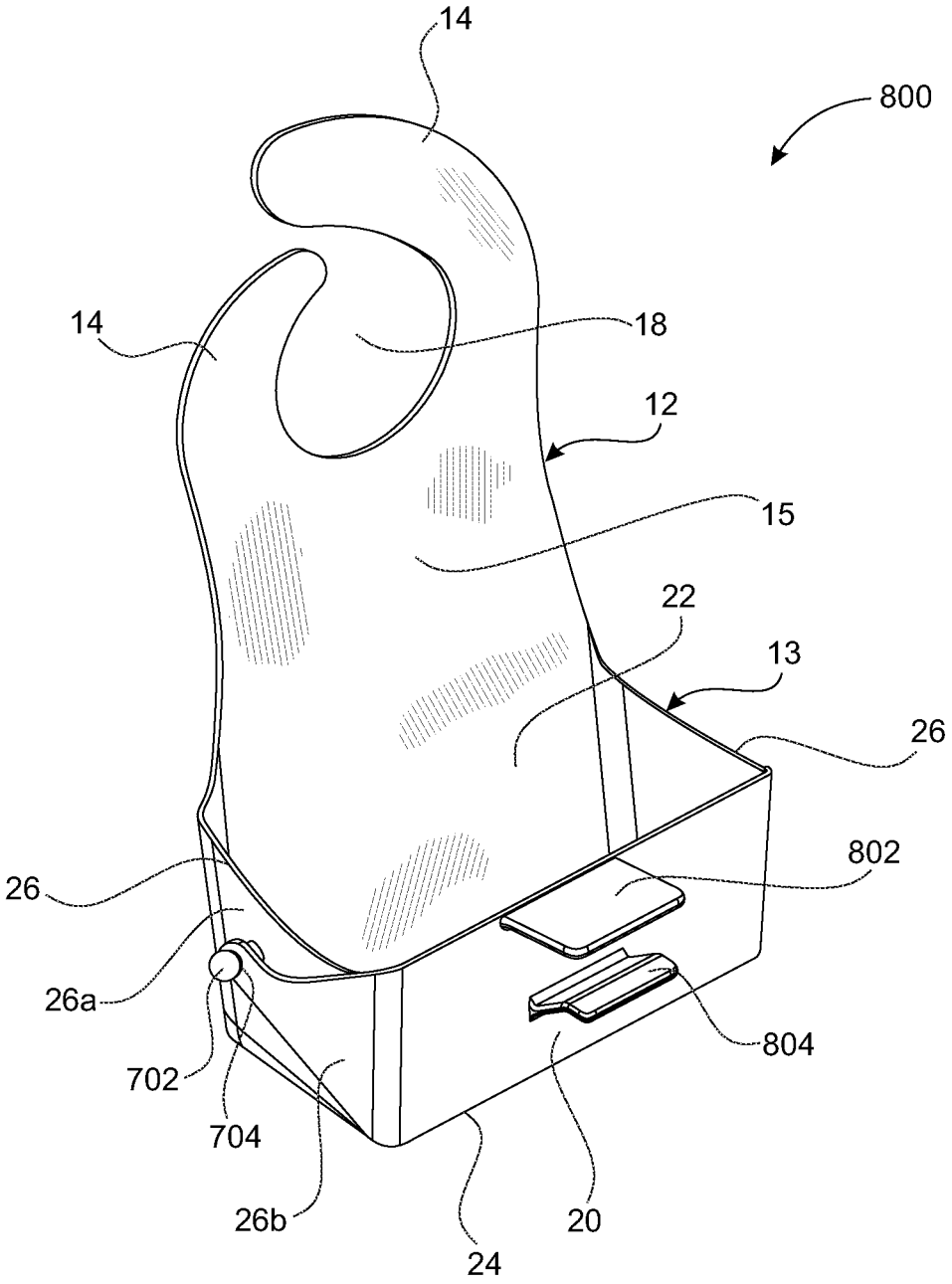
FIG. 14 is a perspective view of a bib according to another embodiment of the present invention.

FIG. 14 shows another embodiment of the bib, generally designated at 800, according to the present invention. The construction of bib 800 is the same as for bib 700 described above with reference to FIGS. 12-13, except for the type of connecting means for removably connecting, securing, and/or attaching pouch 13 to a surface during use of bib 800, such as a highchair tray or table. In the embodiment of FIG. 14, instead of suction cups as shown in FIGS. 12-13, the connecting means comprises spaced-apart upper and lower latch portions 802, 804, respectively, extending from front section 20 of bib 800. Spaced apart latch portions 802, 804 cooperate together to receive therebetween an edge portion of a table, for example, to removably secure bib 800 to the table both in the configuration in which side portion 26*b* is connected to side portion 26*a* and the configuration in which side portion 26*b* is disconnected from side portion 26*a* and extended towards the table, for example. In this regard, lower latch portion 804 is formed of portions which are generally angled relative to one another, to upper latch portion 802, and to front section 20 of bib 800, as shown in FIG. 14, which permits upper and lower latch portions 802, 804 to securely receive and retain therein the edge portion of the table, for example. Additionally, upper and lower latch portions 802, 804 are made of a material flexible enough to allow manual disconnection or removal from the table edge by flexing latch portions 802, 804 away from each other, for example.

Figure 15:
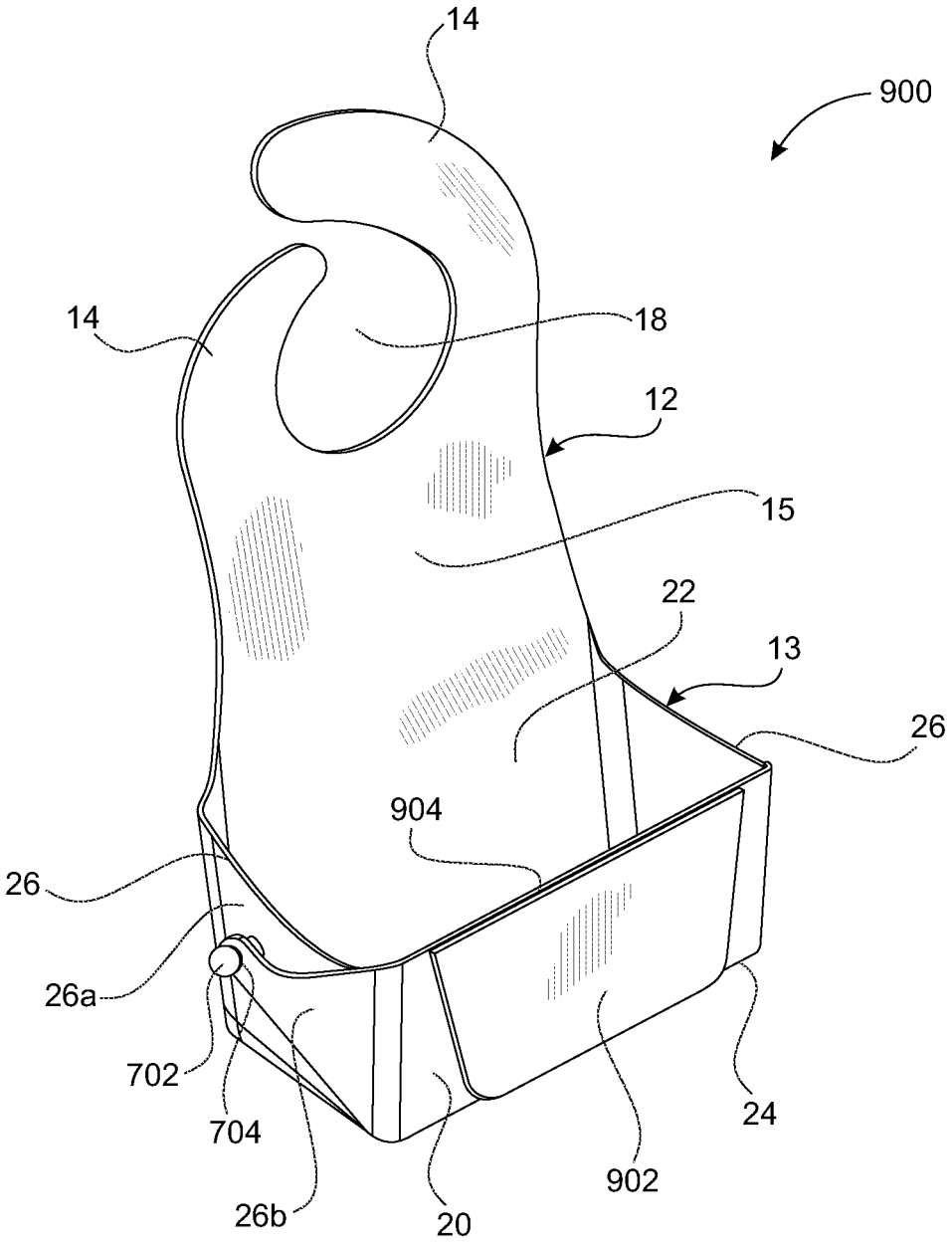
FIG. 15 is a perspective view of a bib according to another embodiment of the present invention.
Figure 16:
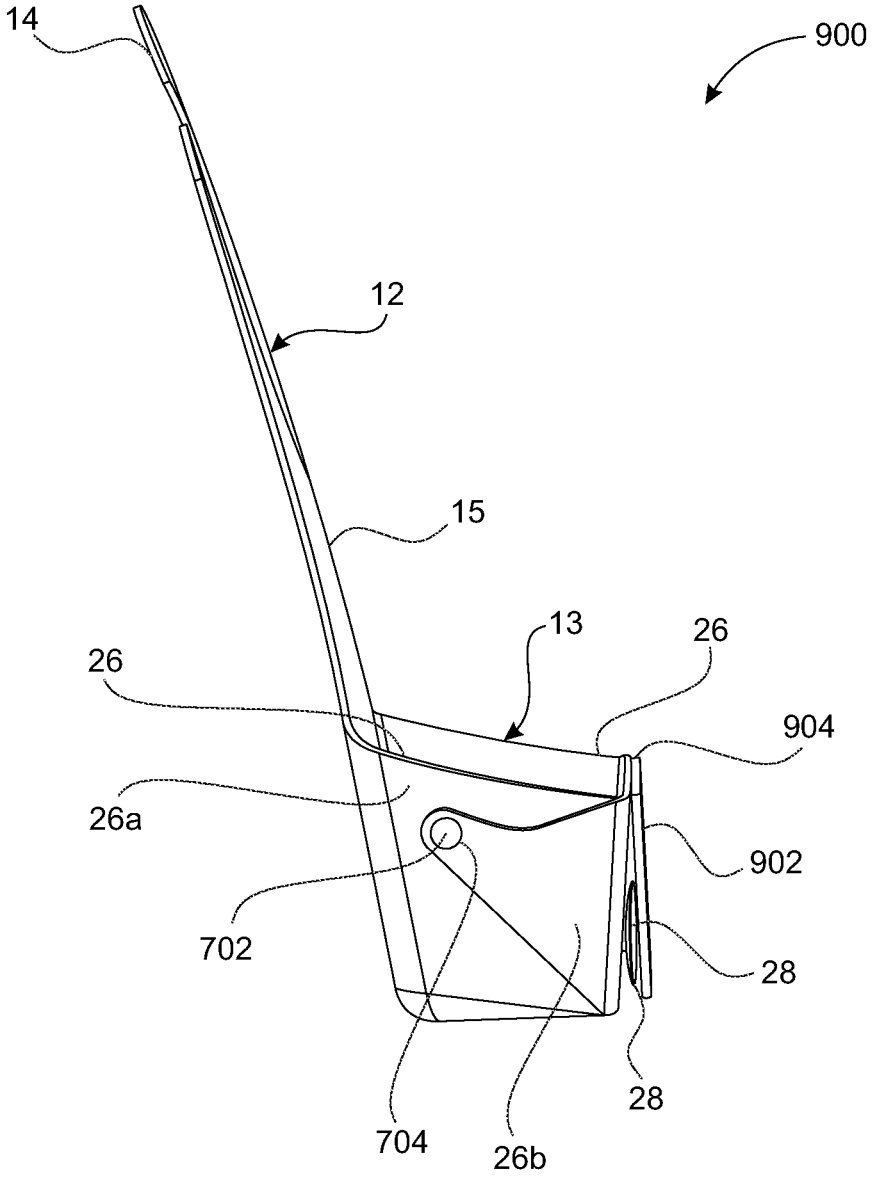
FIG. 16 is a side view of the bib shown in FIG. 15.

FIGS. 15-16 show another embodiment of the bib, generally designated at 900, according to the present invention. The construction of bib 900 is the same as for bibs 700 and 800 described above with reference to FIGS. 12-13 and FIG. 14, respectively, except for the type of connecting means for removably connecting, securing, and/or attaching pouch 13 to a surface during use of bib 900, such as a highchair tray or table. In the embodiment of FIGS. 15-16, the connecting means comprises a folding section 902 configured to be folded along a folding line 904 relative to front section 20 of pouch 13. As shown in FIG. 16, a rear surface of folding section 902 is provided with connecting means (e.g., suction cups) 28 for removably connecting folding section 902, and thereby pouch 13 to an upper surface of a table, for example. FIGS. 15-16 show a configuration of bib 900 in which folding section 902 is not connected to the table surface. In this configuration, folding section 902 is disposed generally over (e.g., generally superimposed) front section 20 of pouch 13. When the user desires to attach bib 900 to a table upper surface, after pin structure 702 is removed from hole 704 to disconnect side portions 26*a*, 26*b* from one another, side portion 26*b* is extended towards the table and folding section 902 is folded or pivoted upward and away from front section 20 about folding line 904 so that folding section 902 can be removably connected to the table surface using connecting means 28. It will be appreciated that the configuration of bib 900, including folding section 902, facilitates placing and securing bib 900 to a table surface during use, thereby exhibiting the foregoing advantages described above with respect to the foregoing embodiments.

Figure 17:
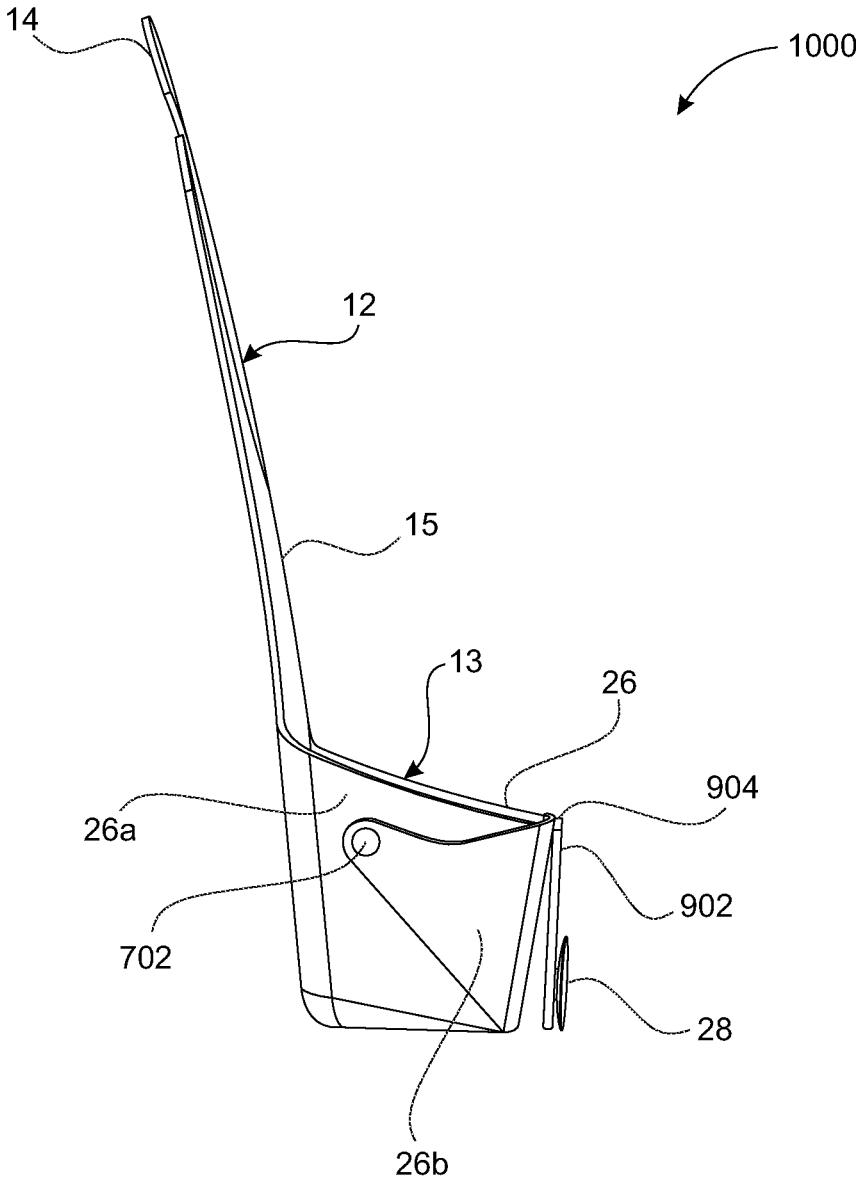
FIG. 17 is a perspective view of a bib according to another embodiment of the present invention.
Figure 18:
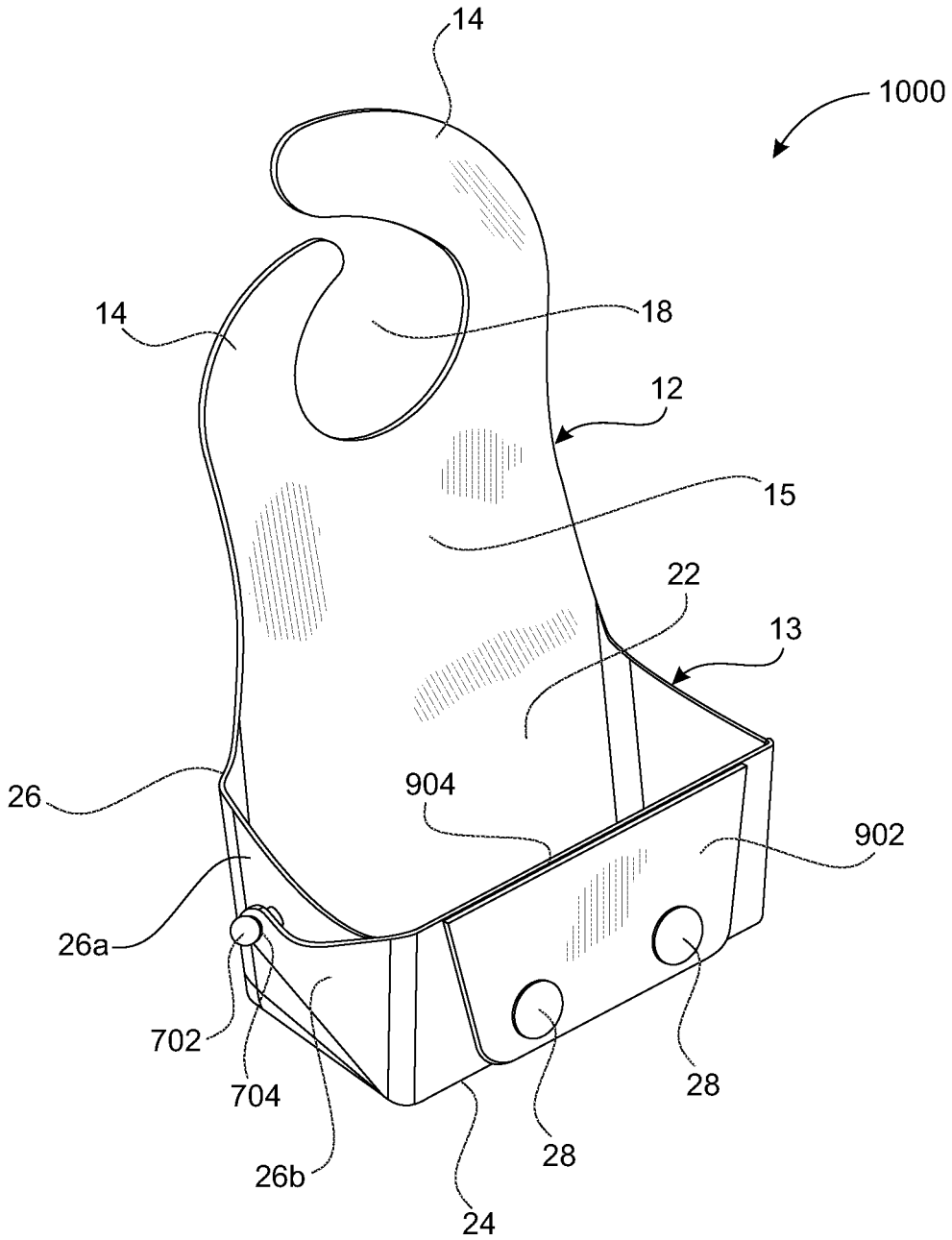
FIG. 18 is a side view of the bib shown in FIG. 17.

FIGS. 17-18 show another embodiment of the bib, generally designated at 1000, according to the present invention. The construction of bib 1000 is the same as for bib 900 described above with reference to FIGS. 15-16, except that in bib 1000 the connecting means 28 (e.g., suction cups) is provided on a front surface, rather than a rear surface, of folding section 902. By this arrangement, bib 1000 is configured for removable connection, for example, to a portion of a table other than an upper surface of the table.

The embodiments of FIGS. 10-18 do not illustrate connecting means 16, 17 for removably connecting straps 14 to one another, as described above for FIGS. 1-9. This has been done for convenience of illustration only, and it is understood that similar connecting means or equivalents thereof may be employed for the bibs in FIGS. 10-18.

It will be appreciated that the bibs according to the embodiments described above for FIGS. 10-18 exhibit most, if not all, of the advantages described above for the bibs in FIGS. 1-9.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A bib comprising:

a main body having a front surface;

first connecting means provided at an upper end of the main body for removably connecting the bib around a user's neck;

a pouch provided at a lower end of the main body contiguous with the front surface for collecting solids and/or liquids dropped by the user during use of the bib, the pouch including second connecting means for removably connecting the pouch to a connecting surface during use of the bib; and wherein the pouch is in the form of a trough-shaped structure having a front section, a base, and side sections, wherein upper edges of the front section and the side sections collectively define a top terminal edge of the pouch; and wherein each of the side sections comprises a plurality of pleats for facilitating attachment of the pouch to the connecting surface by the second connecting means during use of the bib by allowing the pouch to extend out and be maintained open and in a proper orientation for collecting dropped solids and/or liquids; each pleat of the plurality of pleats extending from the base to the top terminal edge of the pouch, the plurality of pleats being configured to allow the top terminal edge of the pouch to be moved toward the connecting surface for removably attaching the front section of the pouch to the connecting surface, and the second connecting means provided on a forward facing surface of the front section of the pouch below the top terminal edge of the pouch.

2. The bib of claim 1, wherein the second connecting means comprises at least one suction cup.

3. The bib of claim 1, wherein the pouch comprises a folding portion formed by the upper edge of the front section of the pouch and a pair of slits formed at respective intersections between the front section and the side sections of the pouch to enable the folding portion to be bent or folded along a folding line in a direction of the connecting surface, the second connecting means being provided on the folding portion.

4. The bib of claim 3, wherein the second connecting means comprises at least one suction cup.

5. The bib of claim 1, wherein the bib is a one-piece, unitary structure made of a single piece of material.

6. The bib of claim 5, wherein the single piece of material comprises silicone.

7. The bib of claim 1, wherein the first connecting means comprises connection straps having inner edges forming a neck receiving aperture shaped to fit the user's neck when the connection straps are connected together; and further comprising an extension section connected to and extending from the inner edges of the connection straps, the extension section being configured to overlap at least a portion of the front surface of the main body during use of the bib.

8. The bib of claim 7, wherein the extension section is connected to the inner edges of the connection straps by at least one of sewing, glue, and fusible bonding.

9. The bib of claim 7, wherein the extension section is removably connected to the connection straps.

10. The bib of claim 7, wherein the main body is made of silicone and the extension section is made of a fabric material.

11. A bib comprising:

a main body having a front surface;

a pouch provided at a lower end of the main body contiguous with the front surface for collecting solids and/or liquids dropped by the user during use of the bib, the pouch including first connecting means for removably connecting the pouch to a connecting surface during use of the bib; and wherein the pouch is in the form of a trough-shaped structure having a front section, a base, and side sections, wherein upper edges of the front section and the side sections collectively define a top terminal edge of the pouch; and wherein each of the side sections comprises a plurality of pleats for facilitating attachment of the pouch to the connecting surface by the first connecting means during use of the bib by allowing the pouch to extend out and be maintained open and in a proper orientation for collecting dropped solids and/or liquids; each pleat of the plurality of pleats extending from the base to the top terminal edge of the pouch, the plurality of pleats being configured to allow the top terminal edge of the pouch to be moved toward the connecting surface for removably attaching the front section of the pouch to the connecting surface, and the first connecting means provided on a forward facing surface of the front section of the pouch below the top terminal of the pouch.

12. The bib of claim 11, wherein the first connecting means comprises at least one suction cup.

13. The bib of claim 11, wherein the pouch comprises a folding portion formed by the upper edge of the front section of the pouch and a pair of slits formed at respective intersections between the front section and the side sections of the pouch to enable the folding portion to be bent or folded along a folding line in a direction of the connecting surface, the first connecting means being provided on the folding portion.

14. The bib of claim 13, wherein the first connecting means comprises at least one suction cup.

15. The bib of claim 11, wherein the bib is a one-piece, unitary structure made of a single piece of material.

16. The bib of claim 15, wherein the single piece of material comprises silicone.

17. The bib of claim 11, comprising second connecting means provided at an upper end of the main body for removably connecting the bib around a user's neck.

18. The bib of claim 17, wherein the second connecting means comprises connection straps having inner edges forming a neck receiving aperture shaped to fit the user's neck when the connection straps are connected together; and further comprising an extension section connected to and extending from the inner edges of the connection straps, the extension section being configured to overlap at least a portion of the front surface of the main body during use of the bib.

19. The bib of claim 18, wherein the extension section is connected to the inner edges of the connection straps by at least one of sewing, glue, and fusible bonding.

20. The bib of claim 18, wherein the extension section is removably connected to the connection straps.

21. The bib of claim 18, wherein the main body is made of silicone and the extension section is made of a fabric material.

* * * * *